United States Patent [19]

Mentis

[11] 3,961,512

[45] June 8, 1976

[54] METAL PUNCHING MACHINE

[76] Inventor: Andrew Mentis, 96 Kloof Road, Bedfordview, Johannesburg, Transvaal Province, South Africa

[22] Filed: Mar. 19, 1975

[21] Appl. No.: 559,962

[30] Foreign Application Priority Data

Mar. 25, 1974 South Africa ..... 74/1915

[52] U.S. Cl. ..... 72/53; 83/300; 83/323; 83/328; 83/405

[51] Int. Cl.² ..... B26D 1/56; B23D 15/02; B21D 31/06

[58] Field of Search ..... 83/112, 153, 213, 255, 83/257, 278, 285, 298, 405, 425.3, 559, 681.2, 685, 734, 300, 310, 322–323, 327–328; 225/97; 226/67–68; 72/53; 51/319

[56] References Cited

UNITED STATES PATENTS

| | | | |
|---|---|---|---|
| 2,857,966 | 10/1958 | Sarka | 83/322 X |
| 3,054,315 | 9/1962 | Sarka | 83/323 |
| 3,296,910 | 1/1967 | Haskin et al. | 83/328 |
| 3,423,976 | 1/1969 | Burney et al. | 51/319 X |
| 3,784,070 | 1/1974 | Vossen | 225/97 X |

*Primary Examiner*—Othell M. Simpson
*Assistant Examiner*—Fred A. Silverberg
*Attorney, Agent, or Firm*—Mason, Fenwick & Lawrence

[57] ABSTRACT

Punching apparatus, preferably for metal strip, comprises at least two pairs of shafts rotatably mounted in a framework wherein the pairs are spaced apart along a feed path and the shafts of each pair are spaced apart one on each side of this path. Each shaft carries an eccentric with the eccentrics on the same side of the feedpath being similarly orientated and the eccentrics of each pair of shafts being orientated 180° apart. A beam is mounted on each side of the feedpath on the corresponding eccentrics and parallel to the path and at least one punch is mounted on one beam extending towards the other beam which carries a complementary die. Means are included for holding and moving a metal strip along the feed path and also for rotating the shafts in unison but such that the shafts on opposite sides of the feedpath rotate in opposite directions.

15 Claims, 3 Drawing Figures

METAL PUNCHING MACHINE

Figures 1, 2:
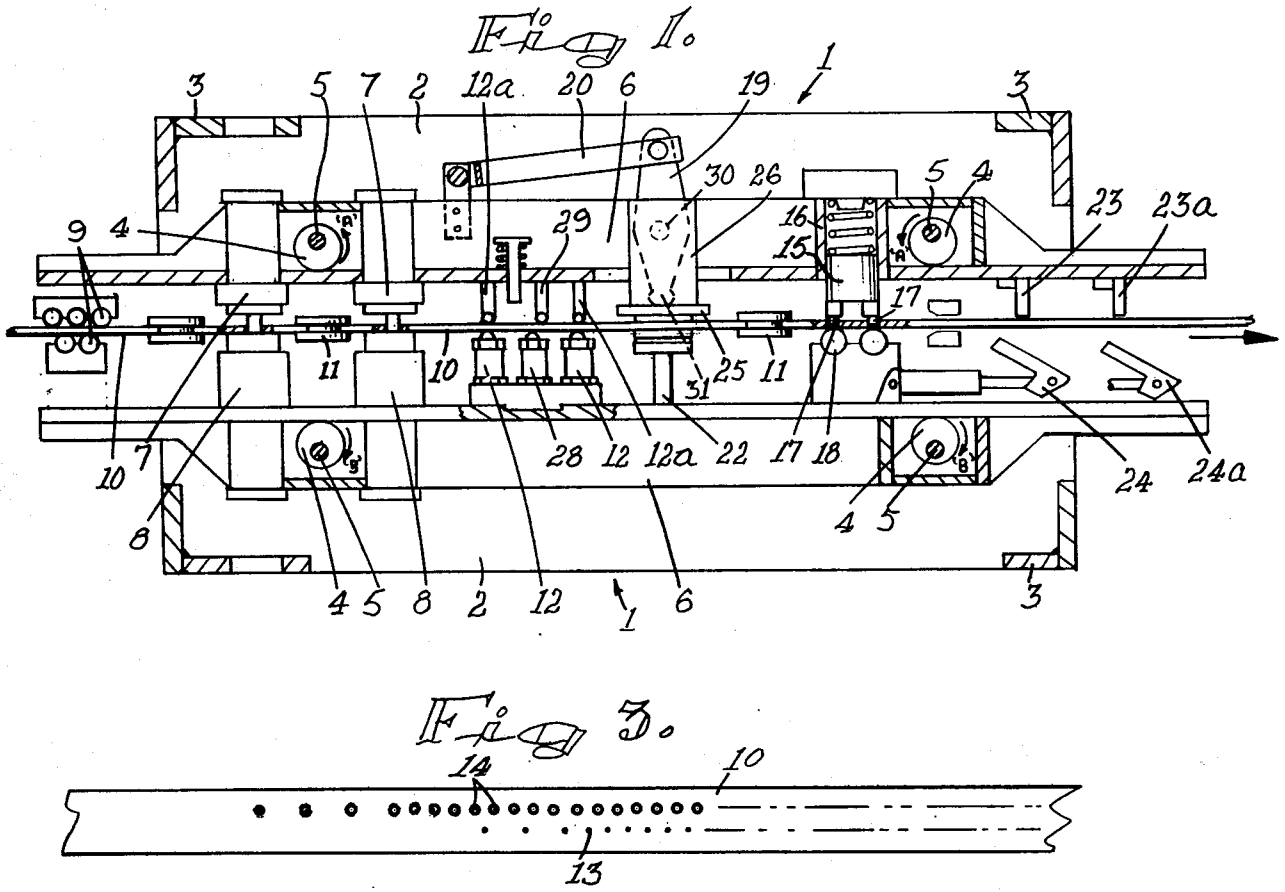
Figure 2:
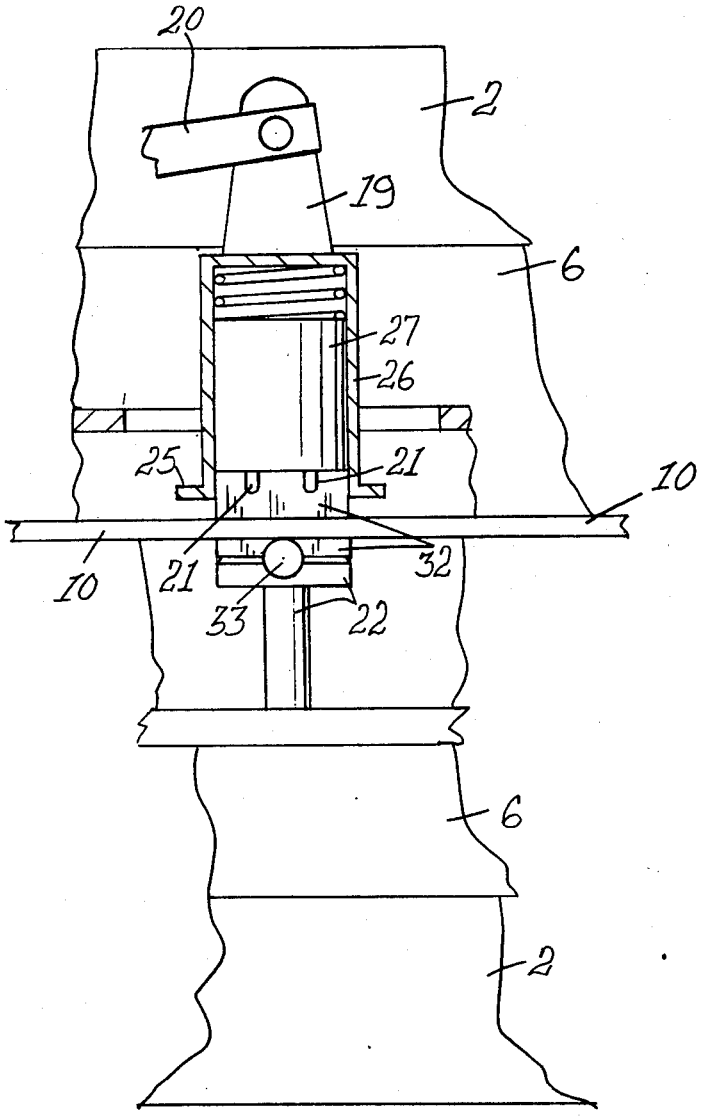

This invention relates to metal punching machines and more particularly to machines adapted to punch a series of generally equally spaced holes along the length of a piece of metal, especially metal in strip form.

In general one of two methods is generally used for punching a series of holes in a strip of metal. The first is a simple punching operation wherein a series of holes are punched simultaneously in a precut length of metal strip in a press of known type. This involves the use of a large number of tools with the resultant high cost thereof and also requires the workpieces to be pre-cut to the desired length which may result in incomplete use of the press being made. Also, generally there is no means on such a machine for preventing bowing of a workpiece where the series of holes extends along a line offset from the centre line. Finally, the operation of the press is relatively slow since feeding is generally most conveniently done by hand.

The present alternative to the above is a punching machine which punches a plurality, say 12 holes at a time along the length of a very long strip of material, this being obviously effected in a stepwise manner. This machine has the disadvantage that an appreciable number of tools are still required and since the stepwise movement is set to a fixed distance (say 400mm) it is not possible to cut off any required length of punched material without an appreciable wastage resulting when the movement of the press is used to effect cutting. In this case the bowing problem is also encountered if the series of holes is offset from the centre line of the strip material.

It is the object of this invention to provide a punching apparatus which will at least to some extent overcome the above described disadvantages of prior art machines.

In this specification the term "pitch" will be used to mean the distance between centres of adjacent holes of a series of equally spaced holes.

In accordance with this invention there is provided punching apparatus comprising a framework, at least two pairs of shafts rotatably mounted on the framework wherein the pairs are spaced apart along a feed path defined in the framework and the shafts of each pair are spaced apart one on each side of said feed path, an eccentric on each shaft with the eccentrics on the same side of said feed path being similarly orientated and the eccentrics associated with each pair of shafts being orientated 180° apart, a beam on each side of the feed path mounted on the corresponding accentrics, the beams being located in parallel with the feed path, a punch on one beam extending towards the other beam, a complementary die on said other beam directly opposite said punch, means for holding and moving a strip of metal along said feed path, and means for rotating the shafts in unison but such that the shafts on one side of the feed path rotate in the opposite directions to the shafts on the other side. eccentrics, Further features of the invention provide for said feed path and beams to be horizontally orientated with the shafts of each pair being vertically spaced apart, for the beams to have two spaced punches thereon and two corresponding complementary dies, for said punches to be spaced apart by an odd number of pitches and for the beams to be fitted with at least one co-operating peening die and anvil for peening the material fed to the apparatus.

The above and many other features of the invention will become apparent from the following description of a preferred embodiment of the invention. In this description reference will be made to the accompanying drawings in which:

FIG. 1 is a partly sectioned diagrammatic side elevation of punching apparatus according to the invention, and FIG. 2 is a sectioned side elevation of means included in the apparatus; and FIG. 3 is a plan view of a length of strip material punched using the apparatus.

In this preferred embodiment of the invention the apparatus is supported in a frame 1 comprising a pair of parallel spaced side plates 2 interconnected by means of a series of braces 3. Supported in bearings in the side plates are two pairs of shafts 4 with each shaft carrying a cranked portion 5 located centrally between the side plates. The shafts of each pair are vertically spaced apart and the cranked portion in each case runs in a journal or bearing (not shown) in one of two vertically spaced beams 6. The above arrangement is such that the two beams 6 are supported by the shafts and are parallel at all times. The beams move in unison towards and away from each other when the shafts supporting the one beam are rotated in an opposite direction relative to those supporting the other beam. The operative directions of rotation of the upper and lower shafts are indicated by arrows 'A' and 'B' in FIG. 1 respectively. Thus, in operation, the two beams move towards and away from each other in a circular path whilst remaining parallel and the movement of each beam has a vertical and horizontal component.

The upper beam in this case carries two punches 7 spaced apart by an uneven number of pitches of the holes to be punched, in this case by five pitches. The lower beam carries complementary dies 8 which, owing to the arrangement of the beams, will always be in vertical alignment with the punches. Thus, as the beams are moved towards and away from each other by rotation of the cranked portions of the shaft, the punches and dies move into and out of co-operation along a vertical line which in fact moves reciprocally in a horizontal direction.

The apparatus is provided at its input end with a set of straightening rollers 9 which, apart from performing their usual function, apply an even tension to strip material 10 fed through the apparatus. Also the path for strip material through the machine is defined by idler rollers 11 rotatable about vertical axes and having grooves in the peripheries thereof for restraining the strip material during passage through the apparatus.

Spaced forwardly of the dies 8 and punches 7 on the lower beam are two spaced hard hammers or peening dies 12 each having a semi-spherical head. A co-operating anvil 12a is fixed on the upper beam for each hammer 12, and the anvils are formed by solid bars of circular cross-section extending across the feed path for strip material. These hammer and anvil arrangements form indentations 13 in use along one edge of the strip as shown in FIG. 3 where the punched holes 14 are offset towards the other edge. This counteracts the stresses set up in the metal strip by the punching operation and thereby avoids bowing or bending of the strip in the plane of the strip itself. The hammers and anvils operate in unison with the punches as will be obvious to one skilled in the art and on consideration of the mode of movement of the beams 6. A further hammer 28 and anvil 29 assembly is provided between the assemblies 12 and 12a in a similar manner but with the hammer offset from the anvil. This assembly prevents bowing of the strip out of the plane of the strip.

The apparatus is provided with two feeding devices one of which holds and feeds the strip material by one pitch during the operative punching half cycle whilst the other moves the strip material forwardly through a distance equal to one pitch during the inoperative or non-punching half cycle. The former comprises a slide 15 slidable in a tubular guide 16 therefor in a vertical direction at right angles to the length of the beams. The slide carries at its outer end a pair of lugs 17 arranged to engage in two adjacent punched holes in the strip material. The slide is spring biased towards an extended position such that it engages in a pair of adjacent holes prior to the punches engaging the strip material. The lugs 17 move the strip forward by one pitch and remain engaged in the strip as the punching cycle proceeds. The lugs subsequently move out of engagement under the influence of the upper beam. The strip material, at this location, is supported on a pair of support rollers 18 to ensure that it remains flat. Thus it will be understood that the lugs in fact follow a semi-circular path during operation of the apparatus and feed the strip and hold it firmly relative to the punches and dies.

The other feeding devices shown in FIGS. 1 and 2 comprises a basically vertical lever 19 pivotally supported as at 30 by the side walls of the frame. At its top end, the lever 19 is pivotally connected to a link arm 20 in turn pivotally attached to the upper beam. The lower end of the lever 19 forms a ball 31 which engages in a socket in a horizontally orientated member 25 and this member carries a vertical cylinder 26 closed at the top. A piston 27 is provided in the cylinder and is spring loaded towards the extended position. Two lugs 21 protrude downwardly from the piston and are spaced apart by one pitch. It will be appreciated that the pivotal arrangement just described ensures that when the beams 6 are moving to the left in FIG. 1, the piston 25 and lugs move to the right and vice versa. The lugs 21, in use, engage two adjacent holes in the strip during the second half cycle of the apparatus and move the strip forward by one pitch. To ensure disengagement of the lugs 21 during the first or punching half cycle, a lifting device 22, attached to the lower beam, is included in the apparatus which moves in unison with the lower beam and presses against an extension 32 on the lower end of the piston 25 to disengage the lugs against the action of the piston spring. The strip, at this location, is also supported on a roller 33 attached to the side frame.

The operative engagement of the two feeding devices is designed to overlap slightly so that the strip is held positively at all times.

Finally the apparatus is provided with two pairs of shearing blades wherein the members 23 and 23A are fixed to the upper beam and the other members 24 and 24A are pivotally attached to the lower beam. The one pair 23 and 24 are fixed longitudinally relative to the beams and may be arranged by any suitable means to cut in between any two pitches; this being done to define the rear end of a desired cut length of punched strip in the process of being punched. The other pair 23A, 24A are adjustable positioned on the beams so that the position of cut on the front end of a cut length of strip already punched may be accurately located. The pivotally mounted blades are preferably activated by solenoids (not shown) which in turn are activated by a metering device which is set for each desired length of material.

The apparatus thus is capable of punching strip material fed from a roll thereof and simultaneously cutting the desired lengths thereof. As the punching half cycle proceeds the strip is fed one pitch and is held by the first feeding device and then punched, the forming of the indents 13 to counteract stress occurring simultaneously. As the punching half cycle finishes the second feeding device takes over to feed the strip material forwardly one pitch so that both punches 7 are actually operative, it being remembered that the punches are spaced apart by an uneven number of pitches and the strip material is fed by two pitches during each full cycle.

It will be understood that many variations may be made to the above described apparatus without departing from the scope of the invention which is directed mainly to the circular movement of the dies and punches.

I claim:

1. Punching apparatus adapted to punch a series of spaced holes along the length of a strip of metal comprising;

a framework, at least two pairs of shafts rotatably mounted on the frame work wherein the pairs are spaced apart along a feed path defined in the framework and the shafts of each pair are spaced apart one on each side of said feed path, an eccentric on each shaft with the eccentrics on the same side of said feed path being similarly orientated and the eccentrics associated with each pair of shafts being orientated approximately 180° apart, a beam on each side of the feed path mounted on the corresponding eccentrics, the beams being located in parallel with the feed path, a punch on one beam extending towards the other beam, a complementary die on said other beam directly opposite said punch, and means for holding and moving a strip of metal along said feed path comprising a member attached to and movable in unison with one of said beams, the member comprising a slide slidable in a guide transverse to said beam, said slide being spring biassed away from the beam toward the feed path and carrying two lugs thereon spaced apart by one or a multiple of pitches to engage an aperture punched in the metal strip during a first half cycle of the apparatus when the beams are in close proximity to each other and to hold the strip during punching and to move the strip forward one pitch immediately after punching as the shafts are rotated in unison with the shafts on opposite sides of the feed path rotating in opposite directions.

2. Apparatus as claimed in claim 1 in which the feed path and also the beams are horizontally orientated with the shafts of each pair being vertically spaced apart.

3. Apparatus as claimed in claim 1 in which the beams have at least two spaced punches thereon, a corresponding complementary die being provided for each punch.

4. Apparatus as claimed in claim 3 in which said punches are spaced apart by an odd number of pitches considering the spacing of punched holes in a punched metal strip.

5. Apparatus as claimed in claim 1 in which the beams are fitted with at least one pair of co-operating shears movable between operative and inoperative positions towards and away from the feed path respectively.

6. Apparatus as claimed in claim 5 in which two pairs of co-operating shears are provided, at least one pair being adjustably movably mounted on the beams along the length thereof.

7. Punching apparatus adapted to punch a series of spaced holes along the length of a strip of metal comprising;

a framework, at least two pairs of shafts rotatably mounted on the framework wherein the pairs are spaced apart along a feed path defined in the framework and the shafts of each pair are spaced apart on one side of said feed path, an eccentric on each shaft with the eccentrics on the same side of said feed path being similarly orientated and the eccentrics associated with each pair of shafts being orientated approximately 180° apart, a beam on each side of the feed path mounted on the corresponding eccentrics, the beams being located in parallel with the feed path, a punch on one beam extending towards the other beam, a complementary die on said other beam directly opposite said punch, and means for holding and moving a strip of metal along said feed path including a device mounted on one of said beams having at least one projecting lug thereon adapted to engage an aperture punched in the metal strip, and a member on the other beam adapted to move said device away from the strip of metal when the beams move together during a first half cycle of the apparatus as the shafts are rotated in unison with the shafts on opposite sides of the feed path rotating in opposite directions.

8. Apparatus as claimed in claim 7, in which said device comprises a slide slidable in a guide, the slide being spring biased away from the beam toward the feed path and carrying said lug, a lever coupled at one end to the guide and pivotally attached to the framework near a central position thereof, the lever being orientated transverse to the feed path, linkages pivotally coupled to the other end of said lever and to one beam such that movement of this beam in one longitudinal direction causes movement of said slide in the opposite direction, and said member on the other beam is adjacent the slide and is adapted to hold the slide away from a metal strip on the feed path during a first half cycle of the apparatus when the beams move toward and are in close proximity to each other.

9. Apparatus as claimed in claim 8 in which the beams have at least two spaced punches thereon, a corresponding complementary die being provided for each punch.

10. Apparatus as claimed in claim 9 in which said punches are spaced apart by an odd number of pitches considering the spacing of punched holes in a punched metal strip.

11. Punching apparatus adapted to punch a series of spaced holes along the length of a strip of metal comprising;

a framework, at least two pairs of shafts rotatably mounted on the framework wherein the pairs are spaced apart along a feed path defined in the framework and the shafts of each pair are spaced apart one on each side of said feed path, an eccentric on each shaft with the eccentrics on the same side of said feed path being similarly orientated and the eccentrics associated with each pair of shafts being orientated approximately 180° apart with respect to their shafts, a beam on each side of the feed path mounted on the corresponding eccentrics, the beam being located in parallel with the feed path, a punch on one beam extending towards the other beam, a complementary die on said other beam directly opposite said punch, means for holding and moving a strip of metal along said feed path, said beams being fitted with at least one cooperating peening die and anvil for peening strip material fed to the apparatus as the shafts rotate in unison with the shafts on opposite sides of the feed path rotating in opposite directions.

12. Apparatus as claimed in claim 11 in which the beams are fitted with two spaced sets of aligned and co-operating peening dies and anvils adapted to form spaced indentations in the surface of a metal strip being punched.

13. Apparatus as claimed in claim 11 in which a further peening die and co-operating anvil is included wherein the die and anvil are offset relative to each other.

14. Punching apparatus adapted to punch a series of spaced holes along the length of a strip of metal comprising;

a framework, at least two pairs of shafts rotatably mounted on the framework wherein the pairs are spaced apart along a feed path defined in the framework and the shafts of each pair are spaced apart one on each side of said feed path, an eccentric on each shaft with the eccentrics on the same side of said feed path being similarly orientated and the eccentrics associated with each pair of shafts being orientated approximately 180° apart with respect to the axes of the shafts, a beam on each side of the feed path mounted on the corresponding eccentrics, the beams being located in parallel with the feed path, a punch on one beam extending towards the other beam, a complementary die on said other beam directly opposite said punch, means for holding and moving a strip of metal along said feed path comprising a member attaced to and movable in unison with one of said beams, the member having at least one lug thereon adapted to engage an aperture punched in the metal strip during a first half cycle of the apparatus when the beams are in close proximity to each other and to hold the strip during punching and to move the strip forward one pitch immediately after punching as the shafts are rotated in unison with the shafts on opposite sides of the feed path rotating in opposite directions.

15. Apparatus as claimed in claim 14 in which the feed path and also the beams are horizontally orientated with the shafts of each pair being vertically spaced apart.

* * * * *